US006364683B1

(12) United States Patent
Kohno

(10) Patent No.: US 6,364,683 B1
(45) Date of Patent: Apr. 2, 2002

(54) ELECTRICAL CONNECTOR

(75) Inventor: Toshiaki Kohno, Kanagawa (JP)

(73) Assignee: AMP Japan, Kanagawa (JP)

( * ) Notice: Subject to any disclaimer, the term of this patent is extended or adjusted under 35 U.S.C. 154(b) by 0 days.

(21) Appl. No.: 09/449,876

(22) Filed: Nov. 29, 1999

(30) Foreign Application Priority Data

Nov. 27, 1998 (JP) ..... 10-337694

(51) Int. Cl.[7] ..... H01R 13/703
(52) U.S. Cl. ..... 439/352; 439/188; 439/489
(58) Field of Search ..... 439/488, 489, 439/352, 188, 350, 357, 358

(56) References Cited

U.S. PATENT DOCUMENTS 3,711,816 A * 1/1973 Schumacher ..... 439/352
5,275,575 A * 1/1994 Cahaly et al. ..... 439/352
5,376,014 A * 12/1994 Sumida ..... 439/352
5,685,743 A * 11/1997 Schmidt et al. ..... 439/352

OTHER PUBLICATIONS

Japanese Patent Disclosure No. 2647335.
Japanese Patent Disclosure No. 2647336.
Japanese Patent Disclosure No. 9–326275.

* cited by examiner

*Primary Examiner*—Hien Vu

(57) ABSTRACT

A locking device (20) is placed on an upper surface of housing (2) of connector (1) in a temporary retained state. The locking device (20) has a pair of beams (78) extending downward obliquely to each other and having notches (78*a*) in surfaces facing each other. The notches have shoulders which engage against a wedge-shaped rib (90) of the housing (2); the shape of the notches (78*a*) corresponds to the shape of the rib (90). Therefore, the locking device (20) cannot be inserted in the housing even by force. When mating connector (200) is coupled with connector (1), rib (230) spreads the beams (78) releasing the engagement between the notches (78*a*) and the rib (90), thus making it possible to insert the locking device (20) to a fully-engaged position.

16 Claims, 10 Drawing Sheets

ELECTRICAL CONNECTOR

FIELD OF THE INVENTION

The present invention relates to electrical connectors, especially to the electrical connectors equipped with a locking device that locks upon the coupling with a mating connector.

SUMMARY OF THE INVENTION

Electrical connectors are known that are equipped with locking devices that can be inserted in the housing to secure the connection of the connector with its mating counterpart. Such locking devices reinforce connection formed with the mating connector, and examples of electrical connectors of this type can be found in Japanese Patent Disclosure Nos. 2647335 and 2647336. Locking devices used in these connectors are designed so that they are attached to the housing in advance and are inserted therein after the connector is coupled with its counterpart, thus reinforcing the completed electrical connection. However, since the design of these locking devices does not provide for a fixed retention location, there is always a risk that the locking device may be accidentally inserted in the housing. In such a case, attempts to couple the connectors may result in deformation or even damage of the locking device and other parts of the connector.

To improve this design, an electrical connector 100 shown in FIG. 17 is disclosed in Japanese Patent Disclosure No. 9-326275. Electrical connector 100 has a housing 102 and a locking device 104 retained on the housing. The locking device 104, in turn, has a separate coupling-confirmation unit 106 that secures the locking device 104 in a specified location of the housing 102. Coupling-confirmation unit 106 has two arc-shaped lugs 110 joined together by a connecting bar 108. In a normal condition, the connecting bar 108 is engaged with the notches 114*a* in legs 114 of the locking device 104, thus preventing the locking device 104 from being inserted in the housing 102. Lower sections of the arc-shaped lugs 110 engage arc-shaped cams 112 of the housing 102. When housing 102 is coupled with a mating connector, the coupling-confirmation unit 106 is rotated by cams 112, thus changing the position of the connecting bar 108 and disengaging legs 114 therefrom, which results in the insertion of the locking device 104 in the housing 102.

However, the problem with the conventional electrical connector described in Japanese Patent Disclosure No. 9-326275 is that the locking device 104 must have a separate coupling-confirmation unit 106, thus making the design more complicated and increasing the number of parts and assembly operations.

Therefore, the purpose of the present invention is to provide an electrical connector that is free of the above-mentioned problems, that is, a connector of a simple design that does not contain separate parts and that can be easily assembled.

SUMMARY OF THE INVENTION

The locking device of the electrical connector according to the present invention has a pair of beams as integral parts of a locking device that are slanted toward each other. The two beams have shoulders engaging with a stop member of the housing. Due to the engagement between the shoulders and the stop member, the locking device cannot be inserted in the housing before the housing is coupled with a mating connector. The important feature of the present invention is that during the coupling, the interaction of the mating connector with the beams results in releasing the engagement between the shoulders and the stop member so that the locking device can be moved to a locking position.

It is desirable that the stop member is wedge-shaped.

The shoulders are in the form of notches provided in edges facing each other of the beams.

The notches have a shape corresponding to that of the wedge-shaped stop member.

It is desirable that in the process of coupling, the beams are pushed apart to a position parallel to each other by a rib on the mating connector, and that the beams are maintained in the pushed-apart position by the rib inserted between them when the mating connector is inserted in the housing.

A locking device of an electrical connector according to the present invention has a pair of beams as an integral part of the locking device that are slanted in a direction toward each other. Engagement of shoulders of the beams with a stop member prevents the locking device from being inserted into the housing, but when the housing is coupled with a mating connector, the engagement between the shoulders and the stop member is released, thus rendering the following effect: namely, due to the fact that the two beams are an integral part of the locking device, the connector has fewer parts and a simpler construction. In addition, since the locking device is a single unit, the number of assembly operations is also reduced. Moreover, since the locking device can be disengaged from a stopped position only if a mating connector is coupled to the housing, an accidental insertion of the locking device into the housing is impossible, thus preventing the locking device from deformation or damage. Since the locking device cannot be inserted into the housing unless the connectors are fully coupled, it can be used as a detector of incomplete coupling of the connectors.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
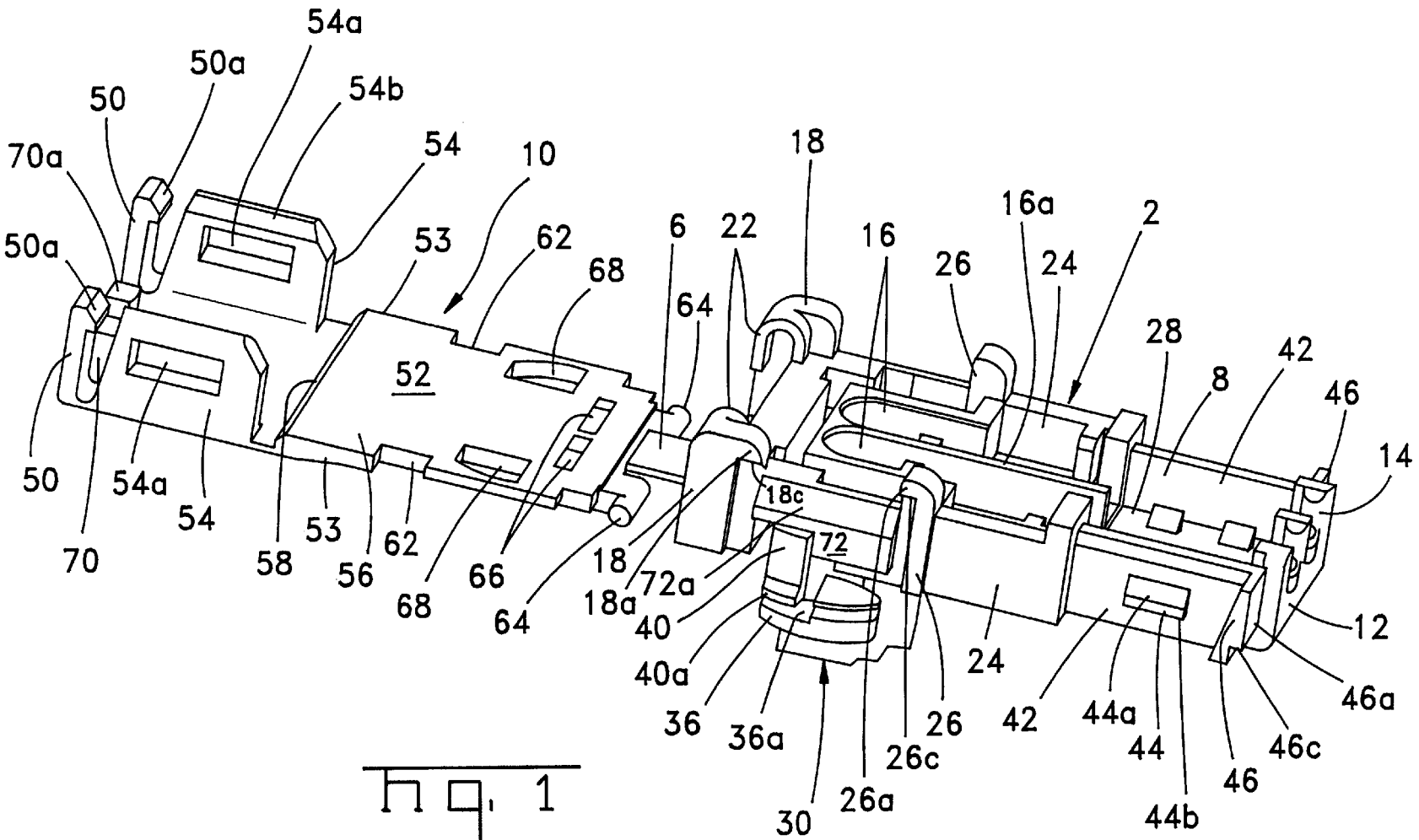
FIG. 1 is an unfolded perspective view of a housing and a cover as an integral part of the housing and connected thereto by a hinge used in an electrical connector according to the present invention.
Figure 2:
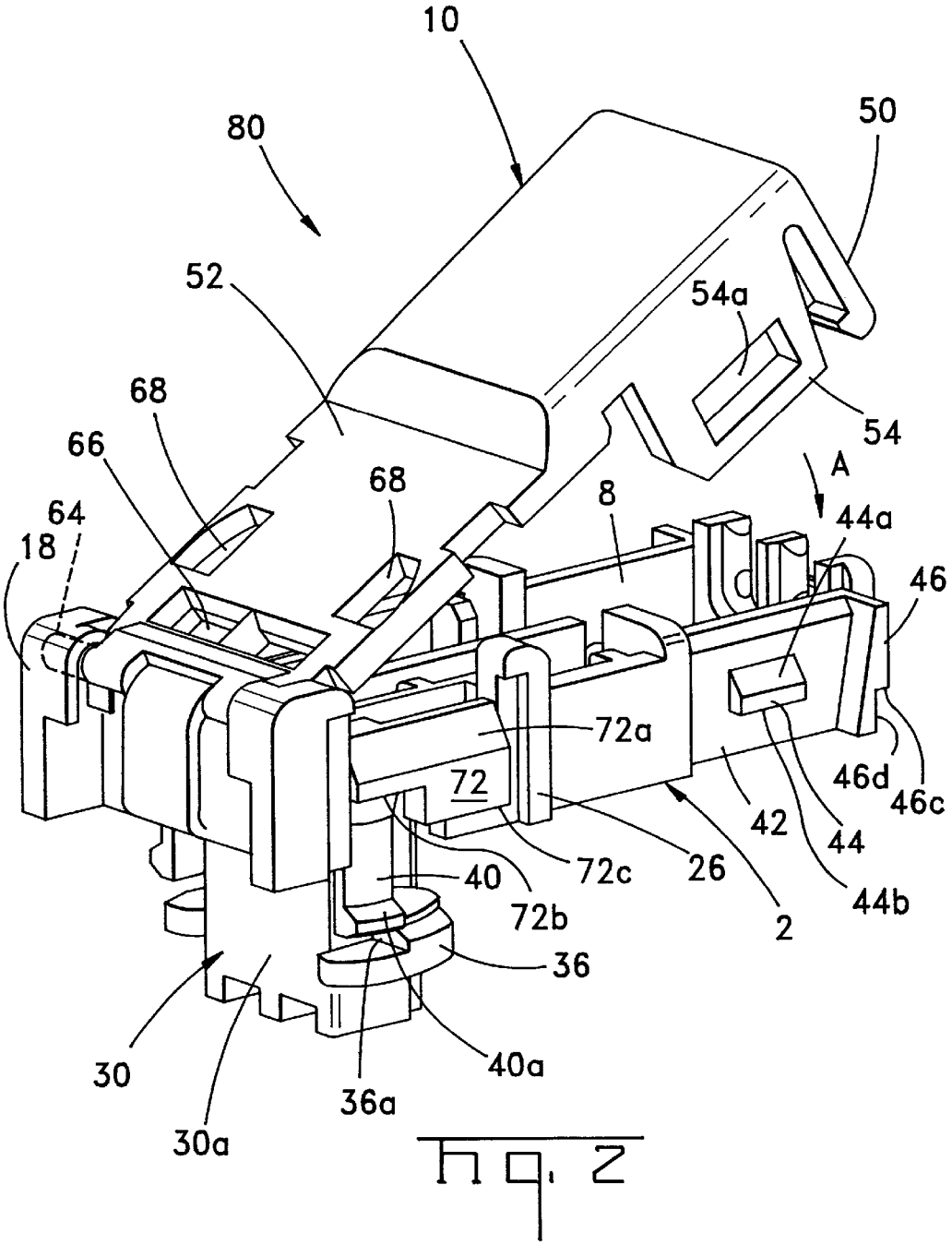
FIG. 2 is a perspective view of the housing and cover shown in FIG. 1 with the cover being near a closed position so as to close a housing opening.
Figure 3:
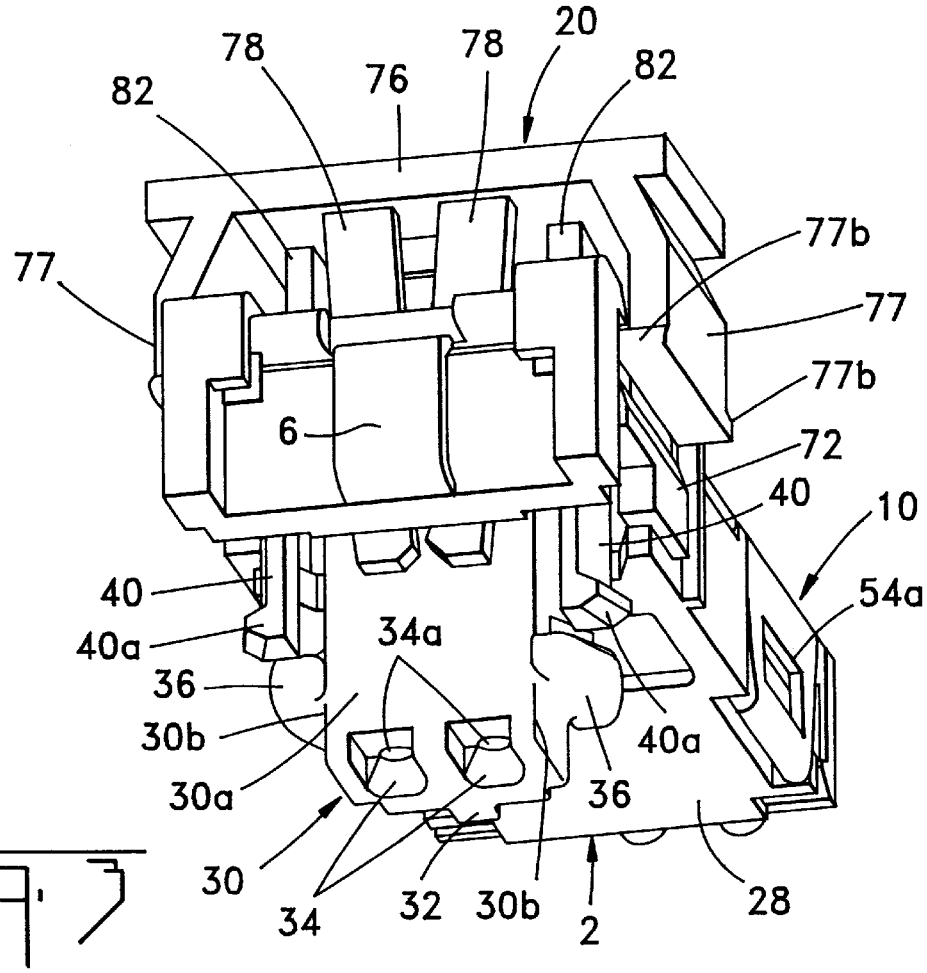
FIG. 3 is a perspective view of the connector with the cover being secured on the housing and a locking device being placed on the housing in a temporary retention position as seen from the front and the coupling unit side.

Housing 2 as shown in FIGS. 1–3 is molded of a suitable plastic material and it has basically a rectangular shape. At its rear wall 12, two parallel U-shaped cut-outs 14 are provided for electrical wires W (see FIG. 4) that are explained below. Inside the housing 2, contact-receiving cavities 16 are located that are divided by a partition 16*a* separating two electrical terminals 150 (see FIG. 6) with attached wires W arranged inside the cavities. On both sides of a front section of the housing 2, two vertical supporting walls 18 are located as integral parts of the housing 2. At the top of supporting walls 18 on their inner sides, U-shaped ribs 22 facing down are located. On both side walls 24, lugs 26 extending vertically are located as integral parts of the housing 2. At upper sections of lugs 26 and at upper sections of supporting walls 18, latching lugs 26*a*, 18*a* are located that extend in the same direction as side walls 24. Latching lugs 26*a*, 18*a* have downwardly-facing latching surfaces 26*c*, 18*c*. Side walls 24 between lugs 26 and supporting walls 18 have latching lugs 72 comprising upper tapered sections 72*a* and shoulders 72*b*, 72*c* located in a lower part and facing downward. Shoulder 72*b* is located above the shoulder 72*c* thereby forming a stepped shape.

At a bottom 28 of the front portion of the housing 2, a coupling unit 30 facing down is provided. The coupling unit 30 has a flat front surface 30*a* and curved surfaces 30*b* at both sides. A bottom surface 32 of the coupling unit 30 is a mating surface that has two depressions 34 therein. In a rear part of each depression 34, openings 34*a* are provided for the insertion of contacts 202 (see FIG. 6) of mating connector 200. At the curved surfaces 30*b* located near the bottom part of the coupling unit 30, a pair of bosses 36 are provided and they are arranged in a transverse direction relative to the housing 2, that is perpendicular to a longitudinal direction of the housing. Above the bosses 36, cantilever lances 40 are provided that extend downward from the housing 2. At the ends of the lances 40, in the vicinity of bosses 36, lance lugs 40*a* extending outward are located. Bosses 36 have stepped surfaces 36*a* that are lower at a front end in which the lance lugs 40*a* located at the ends of lances 40 are arranged.

Rear sections 42 of the side walls 24 of the housing 2 are displaced inside relative to the main sections of the side walls 24 and they have latching lugs 44 at their centers. Latching lugs 44 have tapered upper edges 44*a* extending in the longitudinal direction of the housing 2 and shoulders 44*b* located at a bottom of the latching lugs 44. At the end of the rear sections 42, vertical ribs 46 are provided that extend outward. At a bottom of an outer surface 46*a* of the ribs 46, shoulders 46*c* and surfaces 46*d* are located.

At the front section of the housing 2, cover 10 is located as an integral part of the housing and it is connected to the housing by integral hinge 6. Cover 10 is a rectangular member having a main body 52 and its dimensions are such that it fits over the upper opening 8 of the housing 2. At both sides of a rear end of the cover 10, cantilever latching arms 50 are located. In this case, the side of the cover 10 where it is connected to the housing 2 by the hinge 6 is a front end, and the side where the latching arms 50 are located is a rear end. At outer ends of the latching arms 50, lugs 50*a* are located that extend toward the front end. At both sides of the cover 10 near the latching arms 50, wide cover-latching arms 54 are located as integral members of the cover along both side edges 53 of the main body 52 that extend in the same direction as the cover. In the latching arms 54, rectangular openings 54*a* are provided whose dimensions match those of the latching lugs 44. The front edges of the retaining arms 54 have inner tapered surfaces 54*b* (FIG. 1) to serve as cam surfaces when the cover 10 is secured on the housing 2.

On an inner surface 56 of the main body 52, that is, on an upper surface as depicted in FIG. 1, a step 58 is located that extends across the main body 52. In side edges 53 of the main body 52, cut-outs 62 are provided to accommodate lugs 26 of housing 2, and at the front end, cylindrical supporting pins 64 are located that extend outward in a transverse direction relative to the longitudinal direction of the cover 10. As can be seen from FIG. 2, when the hinge 6 is partly folded to place the cover 10 over the opening 8, supporting pins 64 become engaged with the U-shaped ribs 22. In a front section of the main body 52, aligned slots 66 are located that are arranged perpendicular to the axis of the housing 2, and closely behind the slots 66, openings 68 are located near both edges 53 of the cover. One side of openings 68 that is located closer to the edge is curved. At a rear end of the main body 52, posts 70 having a curved shape 70*a* at an upper end are provided that correspond to the cut-outs 14 in housing 2. When the cover 10 is closed on the housing 2, posts 70 fit into the cut-outs 14 and clampingly engage wires W preventing them from being pulled out.

As can be seen from FIG. 2, the cover 10 is attached to the housing 2 and rotated in the direction shown by arrow A until it is secured on the housing 2 covering the opening 8 as shown in FIG. 3. At this time, openings 54*a* of the latching arms 54 and lugs 50*a* of the latching arms 50 become engaged with respective latching lugs 44 and shoulders 46*c* of the housing 2 thereby securing the cover 10 on the housing 2, thus completing the assembly of the housing unit 80.

Next, explanations concerning the locking device 20 with reference to FIG. 3 are provided. The purpose of the locking device 20 is to reliably secure the mating connector 200 inserted in the housing 2. Locking device 20 includes a rectangular flat main body 76 and two latching members 77 extending obliquely from the main body 76 in an outward direction away from each other, but their lower portions extend parallel to each other. On outer ends of the latching members 77, projections 77*a* (see FIG. 8) are located and they extend inwardly. Lugs 77*b* protrude slightly in a longitudinal direction of the housing at the outer ends of latching members 77. Their purpose is to provide temporary attachment of the locking device 20 to the housing 2 by engaging with latching lugs 18*a*, 26*a* and with latching surfaces 18*c*, 26*c*. In such a state, the locking device 20 is temporarily retained on the housing 2.

At a front end of the main body 76 of the locking device 20, a pair of beams 78 extend downwardly from the main body 76. The beams 78 extend obliquely downward toward each other. Behind the beams 78, a pair of locking arms 82 extend down from the main body 76 parallel to each other and they are located at a greater distance from each other than the beams 78. Functions of beams 78 and the locking arms 82 are explained in detail below.

Figure 4:
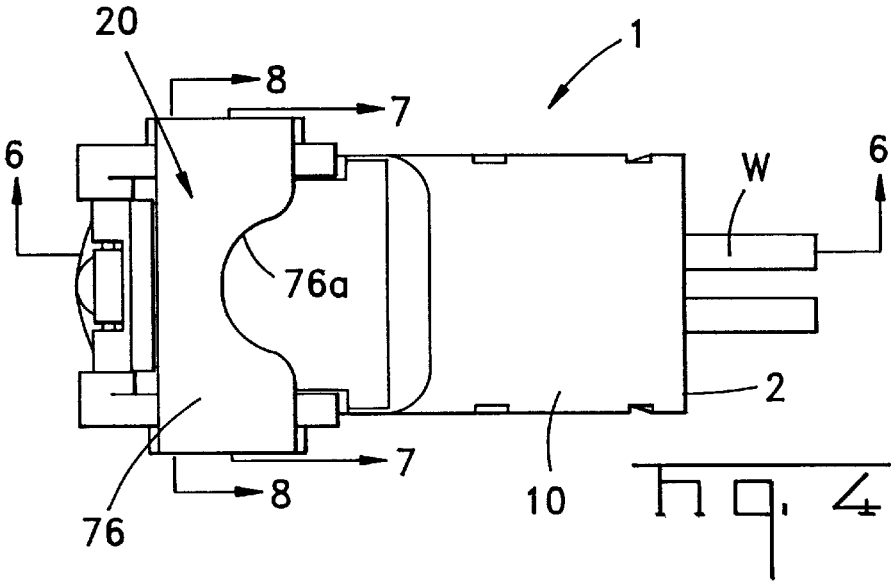
FIG. 4 is a top plan view of the electrical connector depicted in FIG. 3.

As shown in FIG. 4, the locking device 20 has an arcuate surface 76*a* located in a rear surface of the main body 76. The purpose of arcuate surface 76*a* is to provide a rest for the finger pressing on the cover 10 during the coupling of connector 1 and connector 200. FIG. 4 shows electrical wires W extending from a back end of the housing 2.

Below, all steps of the process of the coupling of connector 1 to the mating connector 200 referring to FIGS. 5 through 16 is explained.

Figure 5:
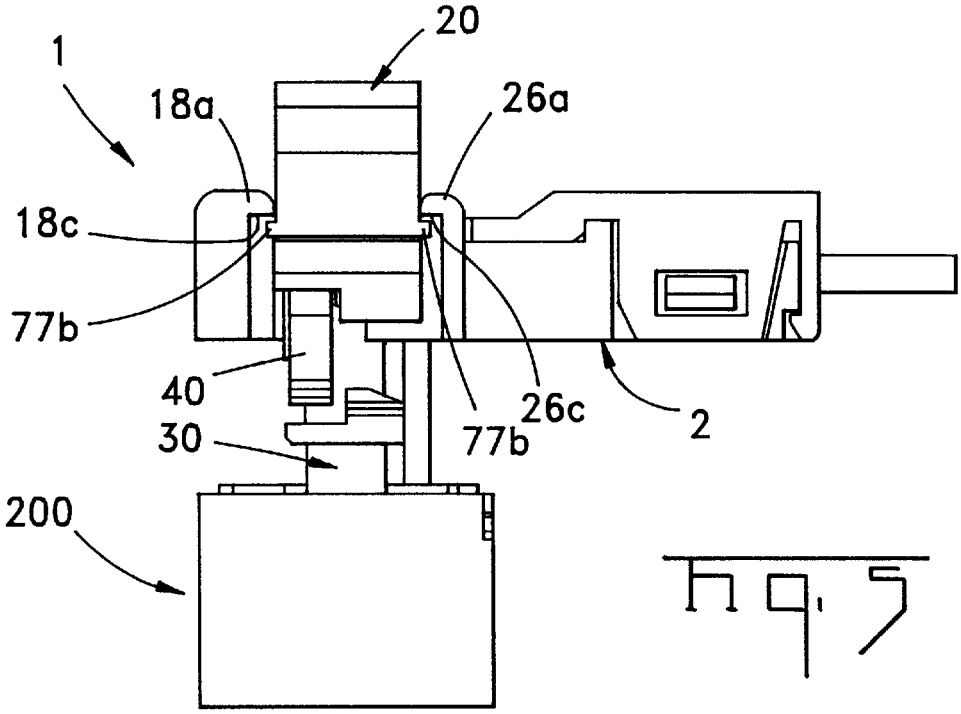
FIG. 5 is a side view of the electrical connector in a state before the coupling to a mating connector.
Figure 6:
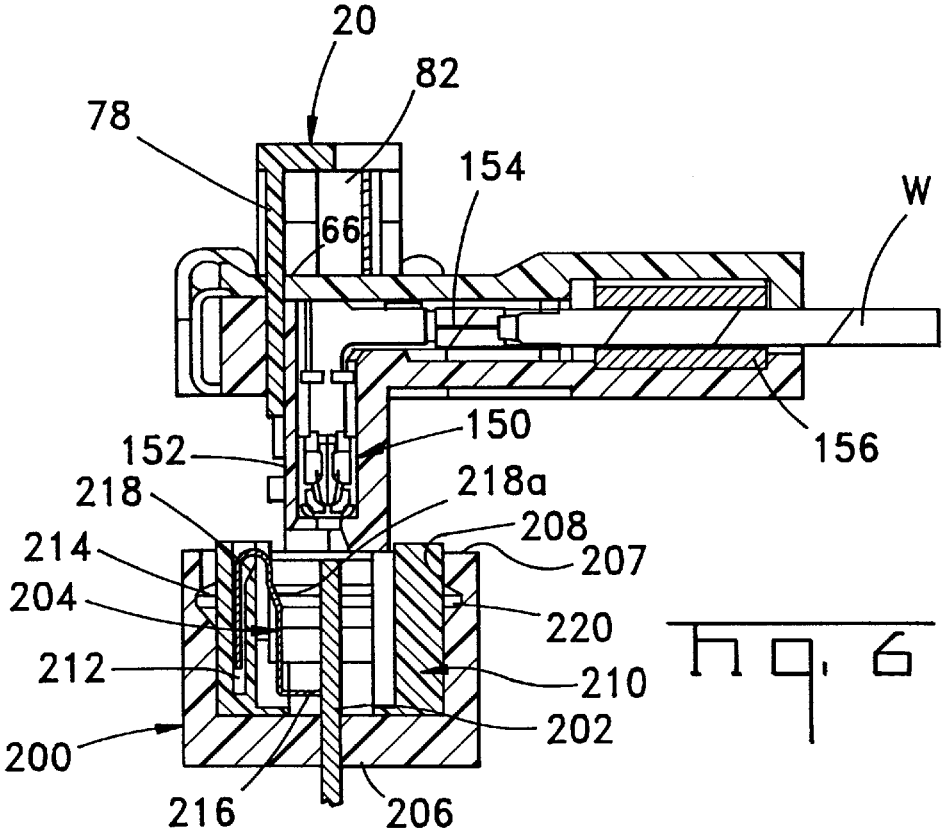
FIG. 6 is a cross-sectional view taken along line 6—6 in FIG. 4 of the electrical connector coupled with the mating connector in the state shown in FIG. 5.
Figure 7:
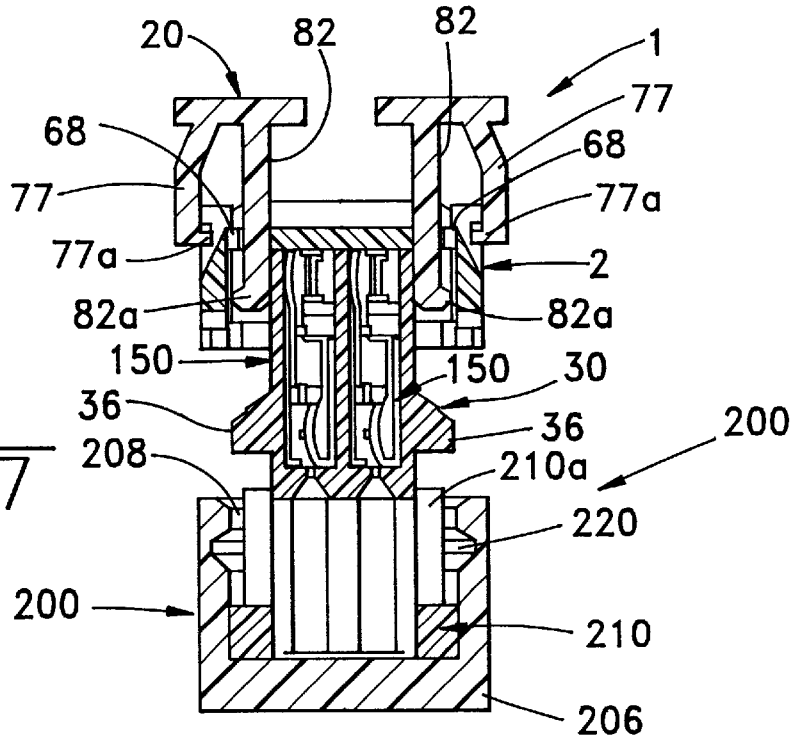
FIG. 7 is a cross-sectional view taken along line 7—7 in FIG. 4 of the electrical connector coupled with the mating connector in the state shown in FIG. 5.
Figure 8:
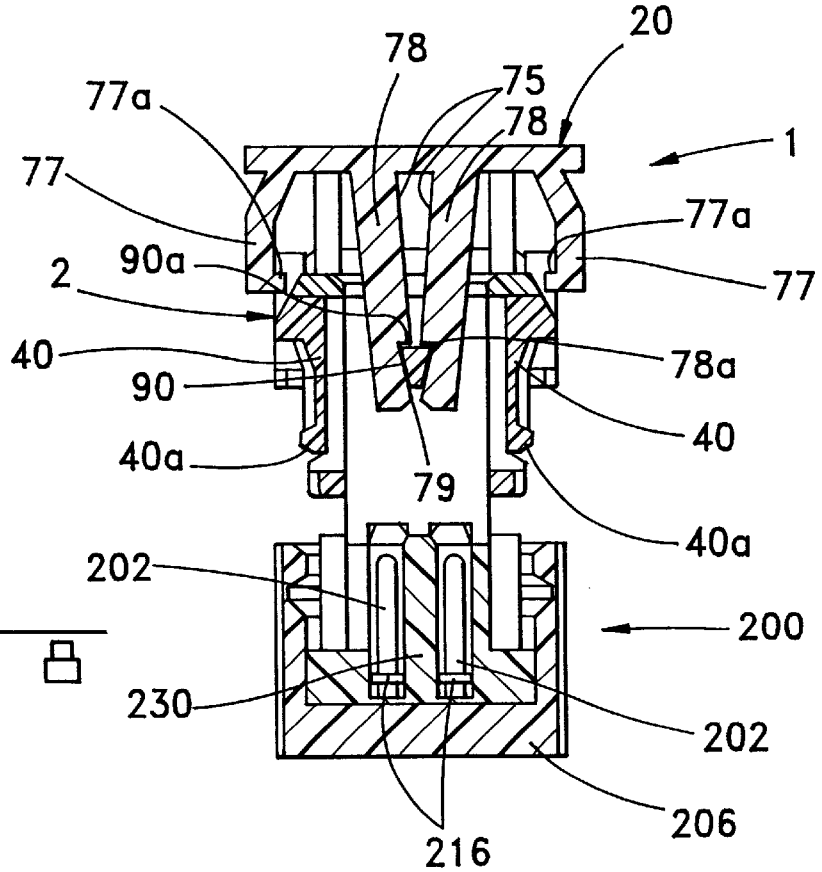
FIG. 8 is a cross-sectional view taken along line 8—8 in FIG. 4 of the electrical connector coupled with the mating connector in the state shown in FIG. 5.

FIG. 5 is a side view of connectors 1 and 200 immediately before the coupling. At this time, the locking device 20 is in the state of temporary retention on the housing 2. FIG. 6 is a cross-sectional view through line 6—6 in FIG. 4 when connectors 1 and 200 are in the positions depicted in FIG. 5. FIG. 7 represents a cross-sectional view through line 7—7 in FIG. 4 when connectors 1 and 200 are in the position depicted in FIG. 5. FIG. 8 is a cross-sectional view through line 8—8 in FIG. 4 of connectors 1 and 200 when they are in the position shown in FIG. 5.

Figure 9:
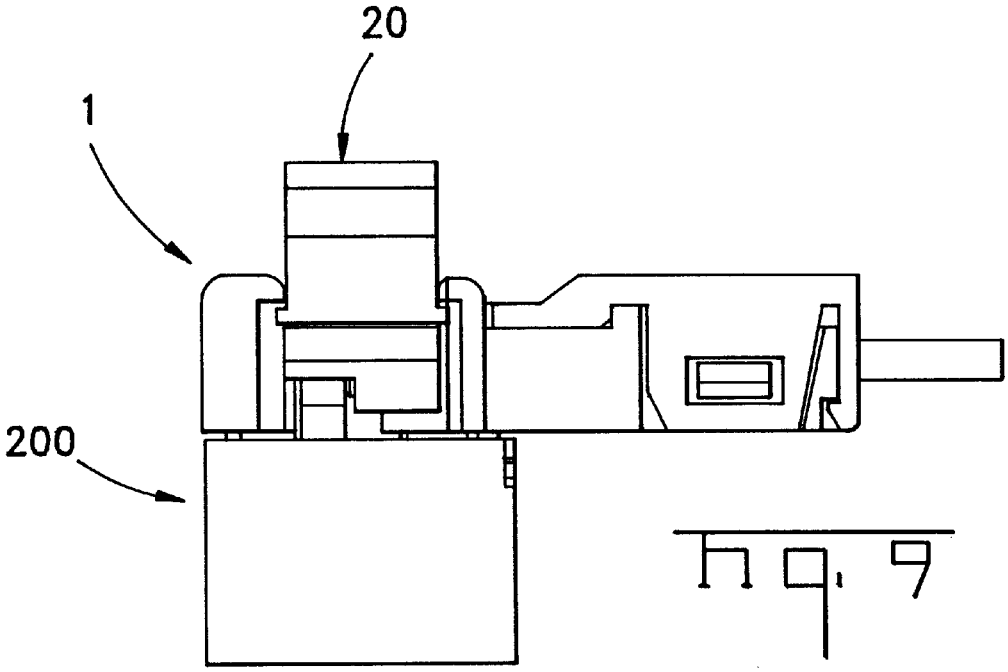
FIG. 9 is a side view of the electrical connector coupled to the mating connector.
Figure 10:
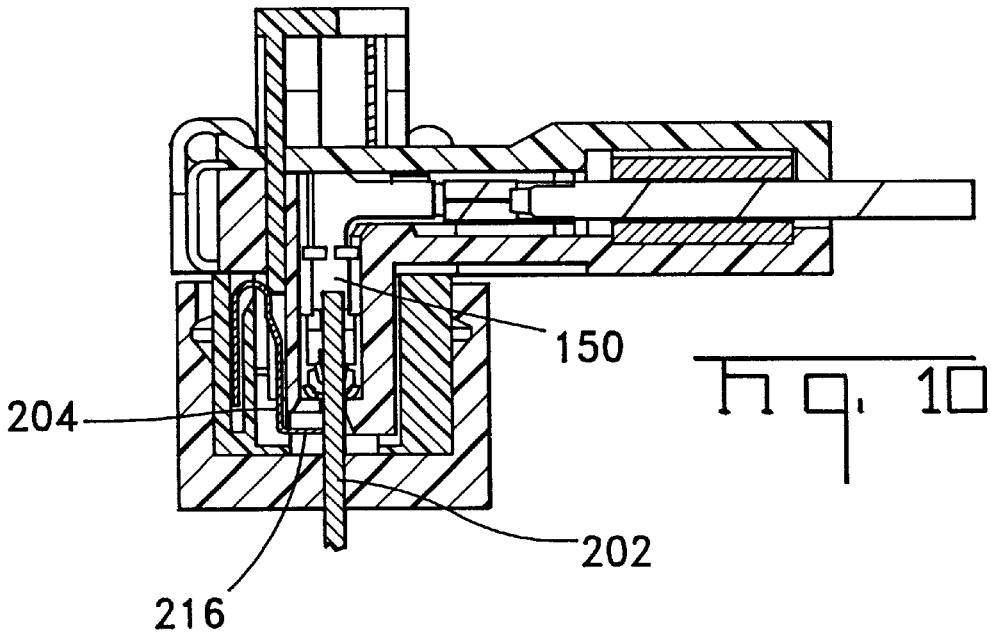
FIG. 10 is a cross-sectional view similar to that shown in FIG. 6 of the electrical connector in the state coupled with the mating connector as depicted in FIG. 9.
Figure 11:
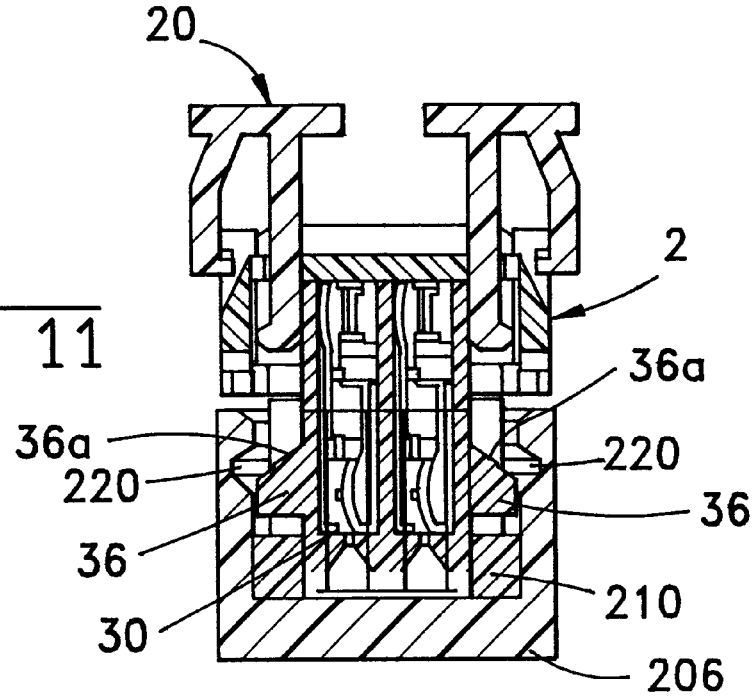
FIG. 11 is a cross-sectional view similar to that shown in FIG. 7 of the electrical connector in the state coupled with the mating connector as depicted in FIG. 9.
Figure 12:
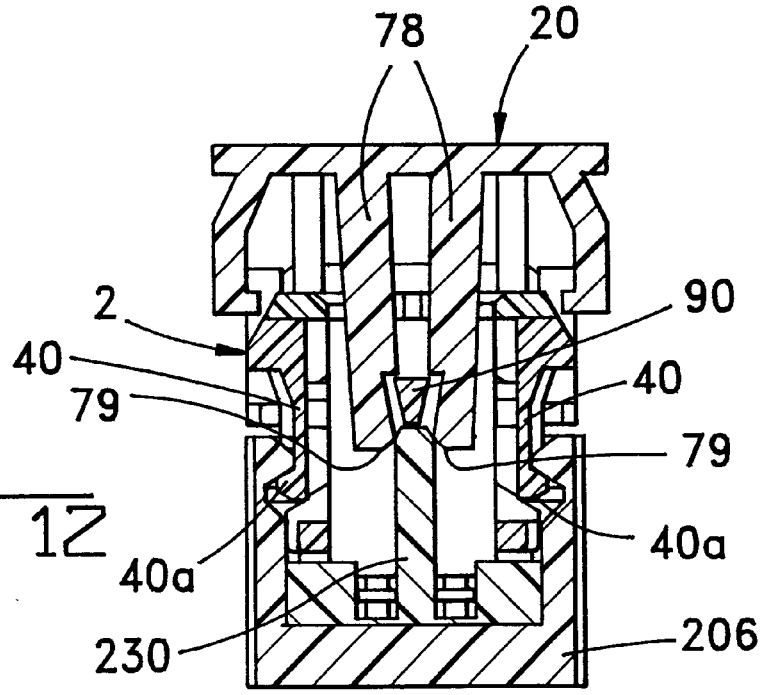
FIG. 12 is a cross-sectional view similar to that shown in FIG. 8 of the electrical connector in the state coupled with the mating connector as depicted in FIG. 9.
Figure 13:
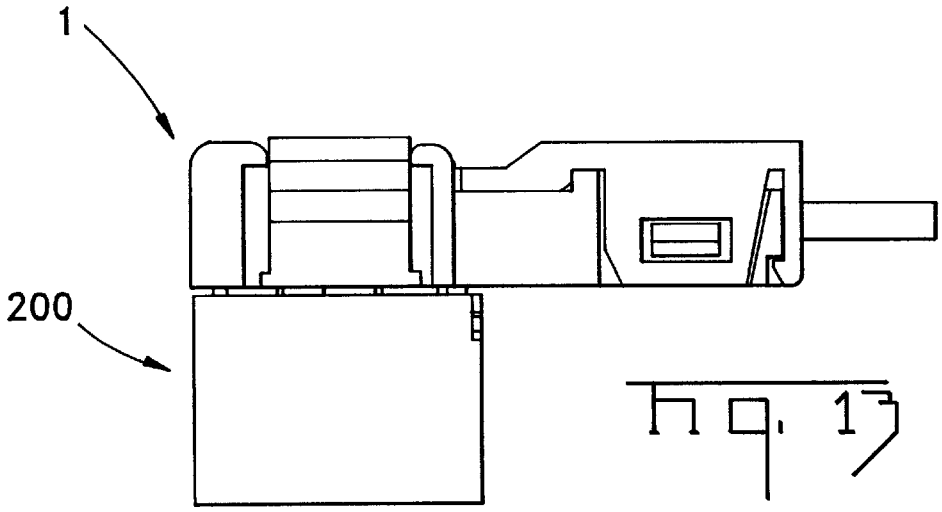
FIG. 13 is a side view similar to that depicted in FIG. 5 showing the insertion of the locking device to a fully-engaged position with connectors in the coupled state.
Figure 14:
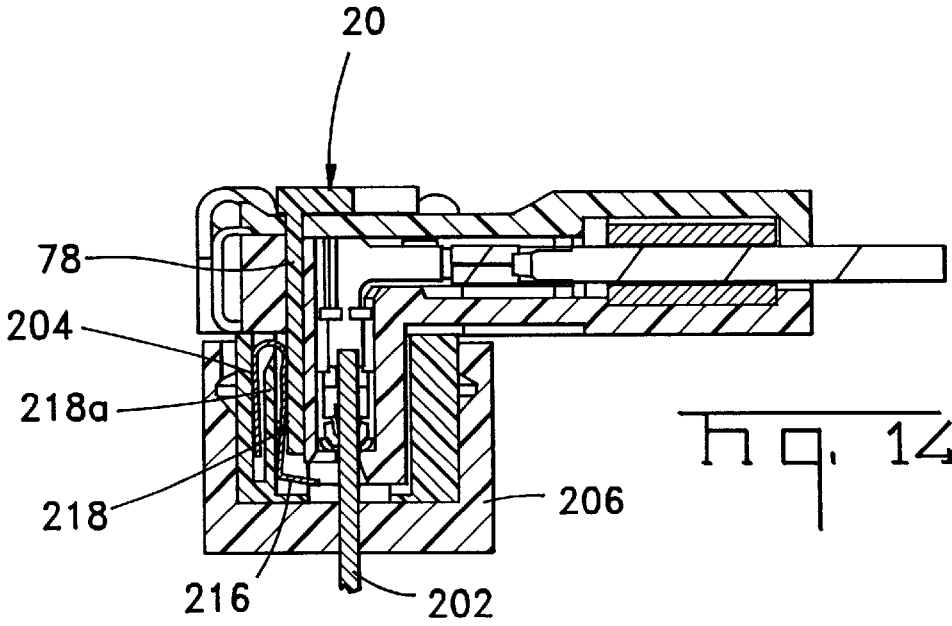
FIG. 14 is a cross-sectional view similar to that shown in FIG. 6 of the electrical connector in the state coupled with the mating connector as depicted in FIG. 13.
Figure 15:
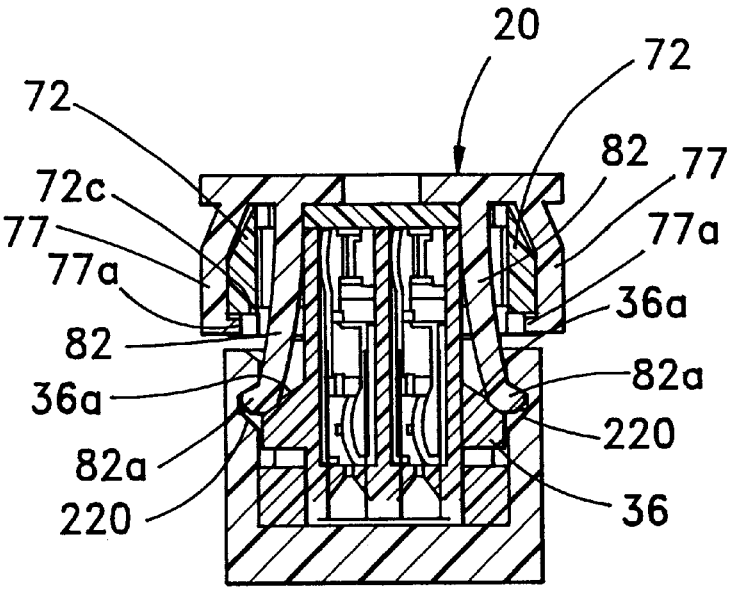
FIG. 15 is a cross-sectional view similar to that shown in FIG. 7 of the electrical connector in the state coupled with the mating connector as depicted in FIG. 13.
Figure 16:
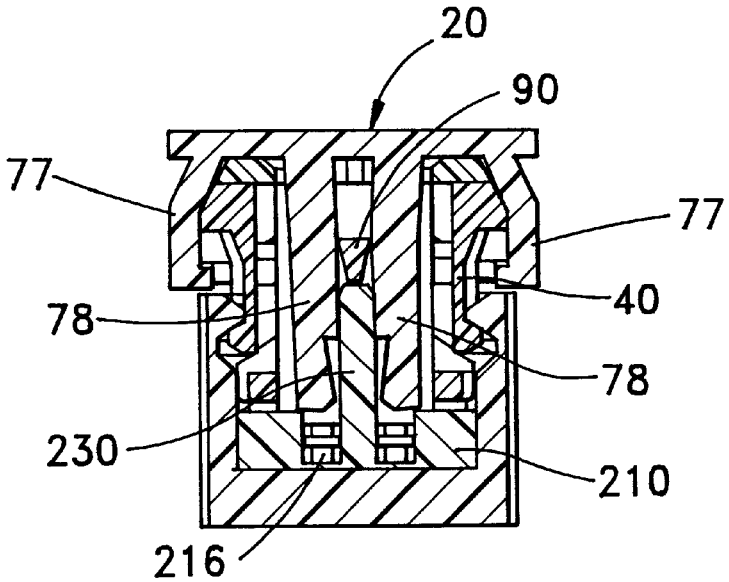
FIG. 16 is a cross-sectional view similar to that shown in FIG. 8 of the electrical connector in the state coupled with the mating connector as depicted in FIG. 13.
Figure 17:
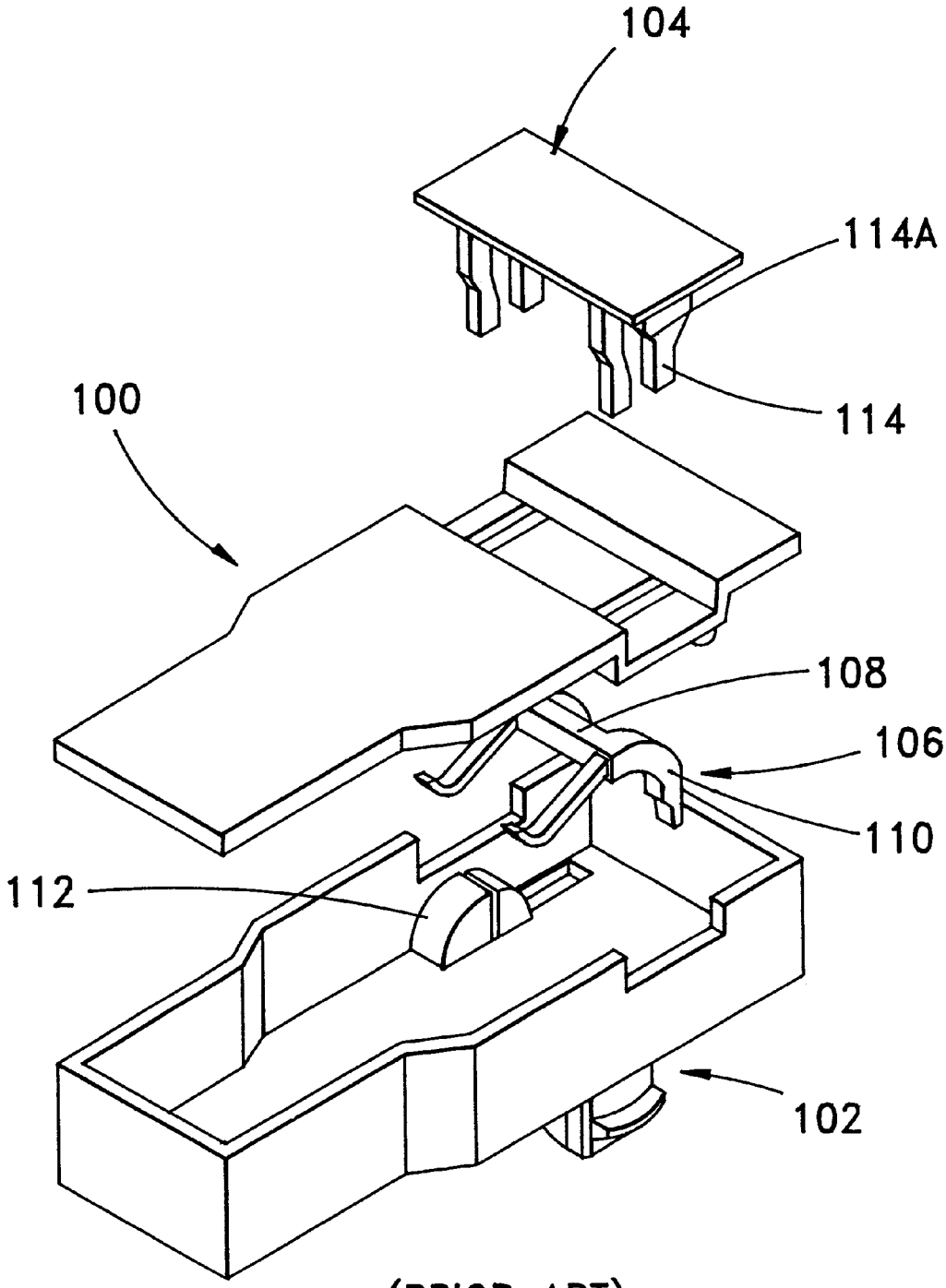
(PRIOR ART) Fig. 17
FIG. 17 is an exploded perspective view of a conventional electrical connector.

FIG. 9 is a side view similar to that shown in FIG. 5 when connectors 1 and 200 are coupled. At this time, the locking device 20 is still in the state of temporary retention. FIG. 10 is a cross-sectional view similar to that depicted in FIG. 6, but with the connectors coupled as in FIG. 9. FIG. 11 is a cross-sectional view similar to that shown in FIG. 7, but with the connectors coupled as in FIG. 9. FIG. 12 is a cross-sectional view similar to that shown in FIG. 8, but with the connectors coupled as in FIG. 9. FIG. 13 is a side view similar to that depicted in FIG. 5 showing the state when the locking device 20 has been pushed into the fully-locked position with the connectors coupled to each other. FIG. 14 is a cross-sectional view similar to that depicted in FIG. 6 but showing the connectors coupled as shown in FIG. 13. FIGS. 15 and 16 are cross-sectional views similar to those depicted in FIGS. 7 and 8, respectively, but when connectors are coupled as shown in FIG. 13.

Referring first to FIG. 5, it can be seen that connector 1 and connector 200 are in such a position that their mating surfaces are in the same plane but the connectors are not coupled yet. One can see that the lance 40 is placed in front of the coupling unit 30. It is clearly seen that in this state the lugs 77*b* are engaged with the latching surfaces 18*c* and 26*c* of the latching lugs 18*a* and 26*a*, respectively, thus attaching the locking device 20 to the housing 2.

Referring to the cross section shown in FIG. 6, it can be seen that the connector 1 has L-shaped electrical contacts 150 arranged in the coupling unit 30. Each contact 150 has a contact section 152 forming electrical connection with a respective electrical contact 202 of the mating connector and a connecting section 154 located at an opposite end of the contact. The connecting section 154 is joined to the electrical conductor of the electrical wire W. As shown in FIG. 6, the electrical wire is passed through a ferrite sleeve 156 installed for the elimination of electromagnetic interference. The beams 78 of the locking device 20 are passed through openings 66 of the cover 10 (FIG. 2) and extend through a bottom surface of the housing 2. The locking arms 82 are displaced with respect to the lances 40 in the longitudinal direction of the housing 2.

The mating connector 200 has a cylindrical housing 206 with a cavity 208 that accommodates a plastic retainer 210. Retainer 210 contains a metal member 204 short-circuiting two electrical contacts 202. Contacts 202 are arranged in a plane perpendicular to the surface of the paper, therefore, in FIG. 6 only one contact 202 is visible.

The metal member 204 has a retaining section 214 that is inserted and secured in slot 212 of the retainer 210 and two spring-loaded arms 218 having a connecting section 218*a* extending from the retaining section 214 and front end sections 216 extending from the spring-loaded arms 218 toward contacts 202. Since the retaining section 214 connects all these sections together and the front end sections 216 form electric connection with the contacts 202, contacts 202 are normally short-circuited. On an inside surface of the housing 206, an annular latching groove 220 is formed at a location relatively close to the mating plane.

Next, referring to FIG. 7, it can be seen that when the locking device 20 is in the state of temporary retention, the locking arms 82 pass through the openings 68 of the cover 10 and extend inside the housing 2. At the ends of the locking arms 82, locking lugs 82*a* are located that extend outward, but when the locking device 20 is in the state of temporary retention, the locking arms 82 are not engaged with any part of the housing. From FIG. 7, it can be seen that the locking arms 82 and bosses 36 are aligned. It is also clear that the contacts 150 are arranged in 2 rows. The latching groove 220 of the housing 206 as shown in FIG. 7 is exposed to the cavity 208 of the housing 206 to a greater degree than to the release portion 210*a* of the retainer 210.

Next, from FIG. 8, it can be seen that when the locking device 20 is in the state of temporary retention, beams 78 are engaged with rib 90 of the housing 2 that has a wedge-shaped cross section. In such a position, downward-directed shoulders of notches 78*a* in opposed surfaces 75 near the ends of the beams 78 engage against upper surface 90*a* of the rib 90, thus blocking downward movement of beams 78. From FIG. 8, it can be seen that beams 78 and lances 40 are at approximately the same position. In the housing 206 of the mating connector 200, two contacts 202 and front end 216 of the metal member 204 that forms electrical connection with contacts 202 can be seen.

FIG. 9 shows the state in which connectors 1 and 200 are coupled together, but the locking device 20 is still in the state of temporary retention. At this time, as can be seen from FIG. 10, electrical connection between the contacts 150 and 202 is accomplished. That is, male or pin contacts 202 are inserted in female or receptacle contacts 150 and the electrical connection therebetween is completed. At this time, the front end 216 of the metal member 204 is still electrically connected to contacts 202.

As can be seen from FIG. 11, bosses 36 of the coupling unit 30 are near the bottom of the retainer 210, and the upper-sloped surfaces 36*a* of the bosses 36 are positioned next to the annular latching groove 220. Male contacts 202 are omitted in FIG. 11. Mutual position of the locking device 20 and the housing 2 is the same as in FIG. 7.

Next, referring to FIG. 12, attention must be given to the fact that lance lugs 40*a* of lances 40 of the housing 2 are engaged with the latching groove 220. Since in such a state the lances 40 will be bent inwardly if the housing 2 is pulled upward, the housing 2 can be detached, and such a state corresponds to temporary retention of the housing 2 and the connector 200. Tapered surfaces 79 at the outer ends of beams 78 of the locking device 20 engage with upper edges of projection 230 of the housing 206 which spreads the beams 78 to the width equal to that of the projection 230 so that beams 78 are now parallel to each other. This results in releasing the engagement of the beams 78 of the locking device 20 from the wedge-shaped rib 90, thus enabling downward movement of the locking device 20.

When the locking device 20 is fully inserted, an upper surface of the locking device 20, as can be seen from FIG. 13, is substantially on the same level as an upper rear surface of the cover 10. In such a state, the position of the locking device 20 inside the housing 206 can be explained as follows. When the locking device 20 is pushed downward, the beams 78 slide between bosses 30 and the spring-loaded arms 218 of the metal member 204 forcing the spring-loaded arms 218 to the side as shown in FIG. 14. As a result, front end sections 216 of the metal member 204 are separated from the contacts 202, thus breaking the short-circuiting of contacts 202.

In this state, as can be seen from FIG. 15, as the locking device 20 is pushed farther down, the outer ends of the locking arms 82 of the locking device 20 reach the slanted surfaces 36*a* of the bosses 36 and are spread apart so that locking lugs 82*a* of the locking arms 82 enter the latching groove 220. Since at the same time, the latching arms 77 become latched due to the fact that projections 77*a* become engaged with shoulders 72*c* of the latching lugs 72 (see FIG. 2), the locking device 20 and the housing 2 cannot be moved upward. This is the fully-locked state of the locking device 20. Therefore, the connector 1 becomes reliably coupled with the connector 200. In addition, the locking arms 82 follow the curved surface 30*b* of the coupling unit 30 (FIG. 3) thereby coming closer to the lances 40. Therefore, outside surfaces of locking arms 82 become curved, and the locking lugs 82*a* also follow the curved surfaces 30*b*, thus providing an additional retention by engaging with the annular latching groove 220.

If the housing 2 is not fully inserted in the connector 200, the bosses 36 block the annular latching groove 220, thus preventing the locking lugs 82*a* of the locking arms 82 to become engaged with the latching groove 220 and making it impossible to press the locking device 20 into the housing 2. This feature can be used as a detector of an incomplete coupling of the housing 2. In addition, since the latching arms 77 of the locking device 20 cannot be locked in the housing 2, the incompletion of the coupling can be easily established by absence of the characteristic clicking sound that takes places when the projections 77*a* of the latching arms 77 engage latching lugs 72.

As can be seen from FIG. 16, beams 78 are located near the bottom of the retainer 210, and since the projection 230 is located between the beams 78, the wedge-shaped rib 90 does not interfere with them and the beams 78 remain parallel to each other. The lances 40 remain in the latched state as explained with reference to FIG. 12. Since the front end sections 216 of the metal member 204 are located in the depressions 34 (FIG. 3), they do not interfere with the housing 2.

Above, detailed explanations concerning a preferred embodiment of the present invention have been provided; however, the embodiment is only an example and the invention is not limited to this specific embodiment. For example, experts in the field may introduce various modifications in the design of the locking device and configuration of beams without departure from the features of the invention.

What is claimed is:

1. An electrical connector for matable connection with a mating electrical connector, comprising:

a dielectric housing, having contact-receiving cavities for receiving electrical contacts therein;

a rib with tapered surfaces provided on the dielectric housing and extending from a surface thereof;

a locking device movably mounted on the dielectric housing;

beams which extend downwardly provided by the locking device and engaged with the rib causing the locking device to remain at a temporary position;

mating projection engagement means provided on the beam, the mating projection engagement means cooperates with a projection in the mating electrical connector during mating engagement therewith causing the beams to be released from the stop member thereby enabling the locking device to be moved to a fully-locked position; and latching arms on the locking device engaging latching lugs on the housing when the locking device is at the fully-locked position.

2. An electrical connector as claimed in claim 1, wherein the rib has a wedge shape.

3. An electrical connector as claimed in claim 2, wherein the beams extend toward one another and include notches in opposing surfaces having downwardly-directed shoulders engaging an upper surface of the rib.

4. An electrical connector as claimed in claim 1, wherein the engaging means on the beams comprise tapered surfaces at outer ends of the beams.

5. An electrical connector as claimed in claim 1, wherein a coupling unit extends downwardly from a front end of the dielectric housing in which contact sections of the electrical contacts are disposed and is positioned within the mating electrical connector when the electrical connector is mated therewith.

6. An electrical connector as claimed in claim 5, wherein the coupling unit includes bosses.

7. An electrical connector as claimed in claim 6, wherein locking arms having locking lugs are provided by the locking device, the locking arms engage the bosses of the coupling unit when the coupling unit is positioned within the mating electrical connector causing the locking lugs to be disposed in a latching groove in the mating electrical connector thereby locking the electrical connector and the mating electrical connector together in a fully-mated position.

8. An electrical connector as claimed in claim 5, wherein the coupling unit includes lances having lance lugs for engagement with a latching groove in the mating electrical connector thereby latching the electrical connector and the mating electrical connector together in a temporary retention position.

9. An electrical connector assembly having a first connector housing and a second mating connector housing, the connector assembly comprising;

a locking device slidably mounted to the first connector housing, the locking device having resilient members extending downwardly from a main body thereof;

a rib with tapered surfaces provided on the first connector housing, the rib dimensioned to engage the resilient members when the locking device is in an open position;

a release projection provided on the second mating connector housing, the release projection dimensioned to cooperate with the resilient members when the second mating connector housing is mated with the first connector housing;

whereby the locking device is maintained in the open position by the rib until the second mating connector housing is mated with the first housing, thereby causing the release projection to engage the resilient members releasing the resilient members from the rib and allowing the locking device to move to a locked position.

10. An electrical connector assembly as recited in claim 9 wherein the resilient members comprise two beams which extend obliquely downward from the main body portion of the locking device.

11. An electrical connector assembly as recited in claim 10 wherein a pair of locking arms extend downward from the main body portion of the locking device parallel to each other, the locking arms cooperate with the second mating connector housing when the locking device is moved to the locked position to maintain the second mating connector housing in position relative to the first connector housing.

12. An electrical connector assembly as recited in claim 11 wherein the beams of the resilient members extend through first openings provided in the first connector housing and the locking arms extend through second openings provided in the first connector housing.

13. An electrical connector assembly as recited in claim 10 wherein the rib has a wedge-shaped cross-section.

14. An electrical connector assembly as recited in claim 13 wherein the beams have notches provided proximate ends thereof, the notches engage a surface of the rib when the connector assembly is in the open position.

15. An electrical connector assembly as recited in claim 13 wherein the beams have tapered surfaces at the outer ends thereof, the tapered surfaces engage upper edges of the release projection when the second mating connector housing is properly mated with the first connector housing, whereby the upper edges are dimensioned to spread the beams to a distance equal to the width of the release projection to release the notches of the beams from the surface of the rib to enable movement of the locking device to the locked position.

16. An electrical connector assembly as recited in claim 11 wherein bosses are provided on the first connector housing to prevent the latching arms to move to the locked position unless the first connector housing and the second mating connector housing are properly mated.

* * * * *

UNITED STATES PATENT AND TRADEMARK OFFICE

CERTIFICATE OF CORRECTION

PATENT NO. : 6,364,683 B1
DATED : April 2, 2002
INVENTOR(S) : Shen

It is certified that error appears in the above-identified patent and that said Letters Patent is hereby corrected as shown below:

Title page,
Item [*] Notice, delete "by 0 days" and insert -- by 19 days --

Signed and Sealed this

Eleventh Day of May, 2004

JON W. DUDAS
*Acting Director of the United States Patent and Trademark Office*